US006442899B1

(12) United States Patent
Gledhill

(10) Patent No.: US 6,442,899 B1
(45) Date of Patent: Sep. 3, 2002

(54) TWO BAR HINGE ASSEMBLY FOR CASEMENT WINDOWS

(75) Inventor: Steven Anthony Gledhill, Old Saybrook, CT (US)

(73) Assignee: Roto Frank of America, Essex, CT (US)

( * ) Notice: Subject to any disclaimer, the term of this patent is extended or adjusted under 35 U.S.C. 154(b) by 0 days.

(21) Appl. No.: 09/742,610

(22) Filed: Dec. 21, 2000

(51) Int. Cl.[7] ..... E05D 15/30; E05D 15/28
(52) U.S. Cl. ..... 49/252; 49/246; 49/161
(58) Field of Search ..... 49/252, 246, 250, 49/345, 248, 161, 162, 187, 396; 16/235, 242, 354, 362, 93 R, 368, 370, DIG. 34, 239; 248/208

(56) References Cited

U.S. PATENT DOCUMENTS

| | | | | | |
|---|---|---|---|---|---|
| 1,489,450 | A | * | 4/1924 | Mesker | 49/252 |
| 4,790,106 | A | | 12/1988 | La See | 49/252 |
| 4,980,947 | A | * | 1/1991 | Mc Quigge | 49/252 X |
| 5,040,267 | A | * | 8/1991 | Dallmann | 49/252 X |
| 5,074,075 | A | | 12/1991 | La See | 49/252 |
| 5,083,344 | A | * | 1/1992 | Pettit et al. | 49/252 X |
| 5,152,102 | A | | 10/1992 | La See | 49/252 |
| 5,491,930 | A | | 2/1996 | La See | 49/252 |
| 5,613,277 | A | * | 3/1997 | Dallmann et al. | 16/368 |
| 5,898,977 | A | * | 5/1999 | Muir | 16/370 X |
| 5,964,011 | A | * | 10/1999 | Ruston et al. | 16/242 X |
| 6,085,464 | A | * | 7/2000 | Lee | 49/246 |
| 6,134,751 | A | * | 10/2000 | Carrier et al. | 16/242 |
| 6,138,325 | A | * | 10/2000 | Figliola et al. | 16/368 X |

FOREIGN PATENT DOCUMENTS

| | | | | |
|---|---|---|---|---|
| GB | 2083131 | * | 9/1980 | 49/345 |
| GB | 2225378 | * | 5/1990 | 16/370 X |

* cited by examiner

*Primary Examiner*—Daniel P. Stodola
*Assistant Examiner*—Hugh B. Thompson
(74) *Attorney, Agent, or Firm*—Marshall, Gerstein & Borun.

(57) ABSTRACT

A hinge assembly for casement windows is shown. The hinge assembly includes a slide block for connection to the sash arm that includes a reinforcing plate that extends downward before extending upward and around the flange of the track overhang. A larger undercut portion is provided beneath the reinforcing plate for added clearance between the slide block and fasteners used to secure the track to the window sill. The hinge assembly also includes a pivot base which is pivotally connected to the shorter tie bar or toggle link. The position of the pivot base with respect to the track can be adjusted to compensate for sash sag. An additional hole is also provided to provide new anchorage in the case of a sash sag adjustment or additional anchorage for use in high wind areas. The pivot base also includes a quick disconnect retainer disposed beneath the pivot base and between the pivot base and the track and thereby hidden from plain view. The short tie bar or toggle link is riveted to a pivot pin thereby eliminating the need for any rivet connection to the track. The pivot pin extends downward from the tie bar through the pivot base and is retained by the retainer which is disposed beneath the pivot base.

22 Claims, 7 Drawing Sheets

TWO BAR HINGE ASSEMBLY FOR CASEMENT WINDOWS

FIELD OF THE INVENTION

The present invention relates to casement windows and, more particularly, to a track and hinge assembly for casement windows with an improved slide block design, a pivot base that is adjustable, a quick disconnect attachment means for connecting short the tie bar to the pivot base and a means for connecting the short tie bar to the pivot base without requiring a pivot pin or cam to be riveted to the track.

BACKGROUND OF THE INVENTION

Casement windows are known in which the window is opened by pivoting the sash about one edge of the sash in contrast to double hung windows where the window is opened by sliding the sash along a track.

In a typical casement window, the bottom edge of the sash is supported by a long tie bar or sash arm that is slidably connected on one end to a track that is mounted to the window sill. A second, shorter tie bar is pivotally connected to the sash arm on one end and pivotally connected to the track at the other end. Current designs utilize a pivot pin that is riveted to the track and that passes through a hole in the tie bar. The tie bar is secured to the pin with a removable clip disposed on top of the tie bar so that the tie bar is sandwiched between the clip and the track.

When the sash is opened, the sash arm and, consequently the sash, slides along the track thereby causing the effective axis about which the sash swings to move towards the center of the window opening. This action results in improved accessibility to both sides of the window for cleaning purposes.

One of the problems associated with casement windows is a phenomenon referred to in the art as "sash sag" which causes the lower swinging edge of the sash to strike the sill when the window is closed. Sash sag may be caused by poor installation of the window unit which causes the window opening into which the sash fits to no longer be square. Sash sag may also be caused by improper hinge positioning by the window manufacturer.

There are two primary means that are available for correcting sash sag. One means includes moving the entire track along the sill to correct the pivot point of the shorter tie bar. A second means involves adjusting the pivot point of the shorter tie bar by creating an adjustable attachment between the tie bar and the track. Specifically, the shorter tie bar is connected to the track with a cam system which enables the pivot point to be moved laterally by rotating the cam thereby resulting in the pivot point of the shorter tie bar being moved with respect to the track which has a fixed position.

However, both of the above methods for compensating for sash sag have inherent disadvantages. Any system where the track is relocated requires the screws that hold the track on the sill to be removed, the track shifted and then fresh holes need to be drilled in the sill to attach the relocated track to the sill. Because the adjustment required may be a small lateral distance, there may not be sufficient distance between the old screw holes and the new screw holes in order to properly secure the track to the sill or the old screw holes may overlap the new screw holes thereby making the lateral adjustment impossible. Further, while the so-called cam systems do not require the track to be moved, they are limited in their ability to move the pivot point of the shorter tie bar a significant distance.

Another disadvantage with currently-available hinges for casement windows is the connection between the shorter tie bar and the track. Specifically, as noted above, the track is typically riveted to either a pin or a cam system which is received through a hole at the end of the tie bar. The pin or cam system is secured to the tie bar with a quick-disconnect clip which, in addition to making the window fabrication easier, enables the sash to be removed and replaced as required.

However, the currently-available quick disconnect clips suffer from several disadvantages. Specifically, the clips are always exposed because it is disposed on top of the tie bars and are unsightly because they are not color matched to the other components. The clips also tend to damage coatings applied to the steel tie bar thereby enabling premature rust and corrosion to occur. Further, special tools are typically required to install and remove the clip. Finally, the clips tend to be expensive to manufacture and difficult to assemble.

Yet another problem associated with hinges for casement windows involves the requirement that the pivot pin or the cam be riveted to the track. Typically, the track is made from thin sheet metal which does not provide sufficient support for a pivot pin resulting in the pins bending over relatively easily when fully loaded and which can lead to connection failure. Further, the engagement of the pivot pins with the tie bars causes damage to the coatings on the tie bars leading to premature rust and corrosion. The pins, like the quick disconnect clips, are also visible which provide an unsightly appearance because they are not color matched to the mating components. Finally, a riveting assembly is required for both the track and tie bar components.

Still another disadvantage with currently-available hinges for casement windows involves the slide block which provides the connection between the longer tie bar or sash arm and the track. Specifically, slide blocks often bind because of a lack of clearance over the screws used to connect the track to the sill. Further, the slide blocks are typically held to the track by a combination of an overhang on the track and a lip or wall of the slide block that is trapped underneath the overhang. Due to the minimal track engagement provided by this system, the slide blocks tend to deform the track and pull out from underneath the overhang. Further, the slide blocks tend to bind with other hardware on the track because of excessive height requirements and, the slide blocks tend to interfere with the vinyl weld seams disposed at the corners of vinyl window sills.

Accordingly, there is a need for an improved hinge and track assembly for casement windows which provides an improved slide block, means for adjusting the position of the pivot pin, means for quickly disconnecting the shorter tie bar from the track, a way to avoid riveting the pivot pin to the track as well as a way to avoid the use of unsightly clips that are in plain view.

SUMMARY OF THE INVENTION

The present invention satisfies the aforenoted needs by providing a hinge assembly for a casement window that comprises a track and a slide block that slidably engages the track. The track comprises an elongated horizontal bottom wall that includes an elongated free side edge. The bottom wall is connected to an overhang opposite the free side edge. The overhang comprises a vertical wall connected to a horizontal wall which, in turn, is connected to a downwardly extending flange so that the horizontal wall is disposed between the flange and the vertical wall and the flange and the vertical wall are substantially parallel to one another. The slide block comprises an outer rail and an inner rail that ride on top of the bottom wall of the track. The inner and outer rails of the slide block support a base section above the bottom wall of the track. The inner rail is connected to an upwardly extending retaining wall that extends between the vertical wall and the flange of the track. The slide block also comprises a slot disposed between the retaining wall and the base section of the slide block. The flange of the track extends downward into the slot. The slide block also includes a reinforcing plate that extends horizontally through at least part of the base section of the slide lock before extending downward underneath the slot before extending upward through at least part of the retaining wall. As a result of these features, an improved slide block is provided with increased track engagement for superior pull-out load capacity. The accommodation of the flange of the overhang portion of the track in the slot disposed between the retaining wall and the base section of the slide block reduces the overall track height requirements.

In a refinement of the present invention, the base section of the slide block comprises an undercut portion disposed below the portion of the plate that extends through the base section. The undercut portion includes a substantially flat area disposed substantially parallel to the portion of the plate that extends through the base section. At least part of the plate that extends downward underneath the slot is disposed vertically below the substantially flat area of the undercut. The undercut provides increased clearance over the screws or fasteners used to secure the track to the window sill.

In another refinement of the present invention, at least one end face of the slide block is recessed along with the ends of the outer rails so that the recessed portion can accommodate weld seams disposed at the corner of a window frame. This feature is particularly useful when the track of the hinge assembly is attached to the sill at one side of the sill so that one end of the track is disposed in close proximity to a corner of the window frame.

In yet another refinement of the present invention, each end face of the sliding block as well as each end of the inner and outer rails is recessed.

In yet another refinement of the present invention, the reinforcing plate of the slide block comprises an upper horizontal portion, a ramp portion, a lower horizontal portion and a vertical portion. The upper horizontal portion extends through at least part of the base section while the ramp portion connects the upper horizontal portion to a lower horizontal portion. The lower horizontal portion connects the ramp portion to a vertical portion. The lower horizontal portion is disposed below the notch and vertically below the upper horizontal portion.

In a further refinement of the present invention, a hinge assembly for a casement window is provided that comprises a track, a tie bar, a pivot base that connects the tie bar to the track, a first fastener that connects the pivot base to the track and a second fastener that connects the pivot base to the window sill. The track comprises an elongated horizontal bottom wall with an elongated free side edge on one side of the bottom wall and an overhang on an opposite side of the bottom wall. The track also comprises an end and a hole disposed in the bottom wall. The pivot base comprises a body having two opposing ends including a first end of the body that is slidably received in the end of the track and at least partially underneath the overhang. The body of the pivot base also includes a second end that is disposed outside of the track. The first end comprises a first elongated hole that is in overlapping registry with the hole of the track. The first elongated hole of the pivot base and the hole of the track receive the first fastener which secures the pivot base and the track to the window sill. The second end of the body of the pivot base comprises at least one other hole, i.e. a second hole, that receives the second fastener for purposes of securing the pivot base to the window sill. The pivot base also comprises a third hole. The tie bar is connected to a downwardly extending pivot pin which is received in the third hole of the pivot base. The position of the first elongated hole of the pivot base with respect to the hole in the track can be adjusted thereby adjusting the position of the pivot base with respect to the track and, more importantly, thereby adjusting the positions of the pivot pin and the third hole of the pivot base with respect to the track. Accordingly, the employment of the first elongated hole enables the position of the pivot base with respect to the track to be adjusted which, in turn, enables the position of the pivot pin and tie bar with respect to the track to be adjusted.

In a further refinement of the present invention, the first elongated hole comprises three distinct slots including a neutral slot disposed between a right slot and a left slot. The slots are shaped to receive the first fastener. The slots are also shaped so that only one of the slots can be in matching registry with the hole in the track at a time. Thus, the installer or adjuster of the window can adjust the pivot axis represented by the pivot pin by choosing one of the three slots of the elongated hole before anchoring the pivot base to the track with the first fastener.

In another refinement of the present invention, the overhang of the track comprises a vertical wall connected to a horizontal wall which, in turn, is connected to a downwardly extending flange as described above. The body of the pivot base further comprises a retaining wall that extends upward between the flange and the vertical wall of the overhang. The retaining wall of the pivot base also includes a right prong and a left prong. The right and left prongs engage the underside of the horizontal wall when the neutral slot of the first elongated hole is in matching registry with the hole in the track. In contrast, the left prong engages the underside of the horizontal wall of the overhang and the right prong is disposed outside of the overhang and visible to the installer when the left slot of the first elongated hole is in matching registry with the hole in the track. In further contrast, the right prong engages the underside of the horizontal wall of the overhang and the left prong is disposed outside of the overhang when the right slot of the first elongated hole is in matching registry with the hole in the track. Thus, the right and left prongs provide a visual indicator as to the relative position of the pivot base with respect to the track.

In another refinement of the present invention, the second end of the body of the pivot base comprises a fourth hole that is spaced apart from the second hole. The fourth hole provides an additional means for securing the pivot base to the window sill which can prove useful after the position of the pivot base has been adjusted to compensate for sash sag. Specifically, the fourth hole provides a fresh surface into which a screw can be drilled for securing the pivot base to the window sill.

In a further refinement of the present invention, the body of the pivot base comprises an underside and the pivot pin comprises a distal end. The pivot base further comprises a retainer secured to the underside of the body of the pivot base. The retainer engages the distal end of the pivot pin after the pivot pin has been passed downward through the third hole. The retainer removably and pivotally secures the pivot pin to the third hole.

In a further refinement of the present invention, the retainer is a spring clip.

In a further refinement of the present invention, the body of the pivot base further comprises an access slot disposed above the retainer for permitting a tool to be inserted through the slot to engage and move the retainer thereby disengaging the retainer from the pivot pin. In yet a further refinement of the present invention, the tool is a flat head screwdriver.

In still another refinement of the present invention, the track comprises three holes spaced along the track for securing the track to the window sill. The secondary and tertiary holes in the track are spaced remotely from the first hole in the track and the pivot base.

In another refinement of the present invention, a hinge assembly for a casement window is provided that comprises a track, a tie bar, a pivot base that connects the tie bar to the track, a first fastener that connects the pivot base and the track to the window sill and a second fastener that connects the pivot base to the window sill. The track comprises an elongated horizontal bottom wall having an elongated free side edge on one side thereof and an overhang on an opposite side thereof. The track also comprises an end and a hole disposed in the bottom wall of the track. The pivot base comprises a body having two opposing ends including a first end that is slidably received in the end of the track and at least partially underneath the overhang and a second end of the body that is disposed outside of the track. The first end of the body of the pivot base comprises a first hole in registry with the hole in the track. The first hole of the pivot base and the hole of the track receive the first fastener. The second end of the body of the pivot base comprises at least a second hole for receiving the second fastener. The pivot base further comprises a third hole. The tie bar is connected to a downwardly extending pivot pin that is received downward through the third hole of the pivot base. The body of the pivot base further comprises an underside and a retainer secured to the underside of the body. The retainer engages the pivot pin after the pivot pin has been passed through the third hole. The retainer removably and pivotally secures the pivot pin to the third hole of the pivot base.

In another refinement of the present invention, a hinge assembly for a casement window is provided that comprises a track, a tie bar and a pivot base that connects the tie bar to the track. The track comprises an end. The pivot base comprises a body comprising two opposing ends including a first end of the body that is slidably received in the end of the track and a second end of the body that is disposed outside of the track. The first end of the body of the pivot base comprises a hole. The tie bar is connected to a downwardly extending pivot pin which is received downward through the hole of the pivot base so that the tie bar is disposed above the pivot base with the pivot base being disposed between the track and the tie bar.

In a further refinement of the present invention, the body of the pivot base comprises an underside and a retainer is secured to the underside of the body of the pivot base that engages the pivot pin and secures the pivot pin in the hole of the pivot base thereby removably and pivotally securing the pivot pin to the pivot base.

Other refinements, aspects, objects and advantages of the present invention can be obtained from a study of the drawings, the specification and appended claims.

BRIEF DESCRIPTION OF THE DRAWINGS

The invention is illustrated more or less diagrammatically in the following drawings wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
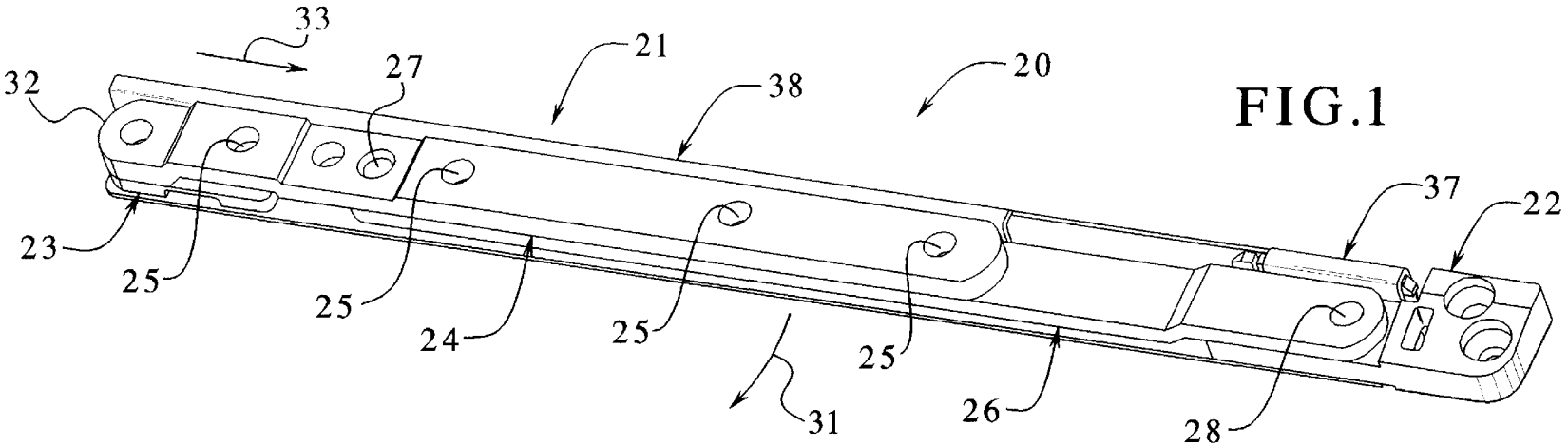
FIG. 1 is a perspective view of a hinge assembly made in accordance with the present invention.
Figure 11:
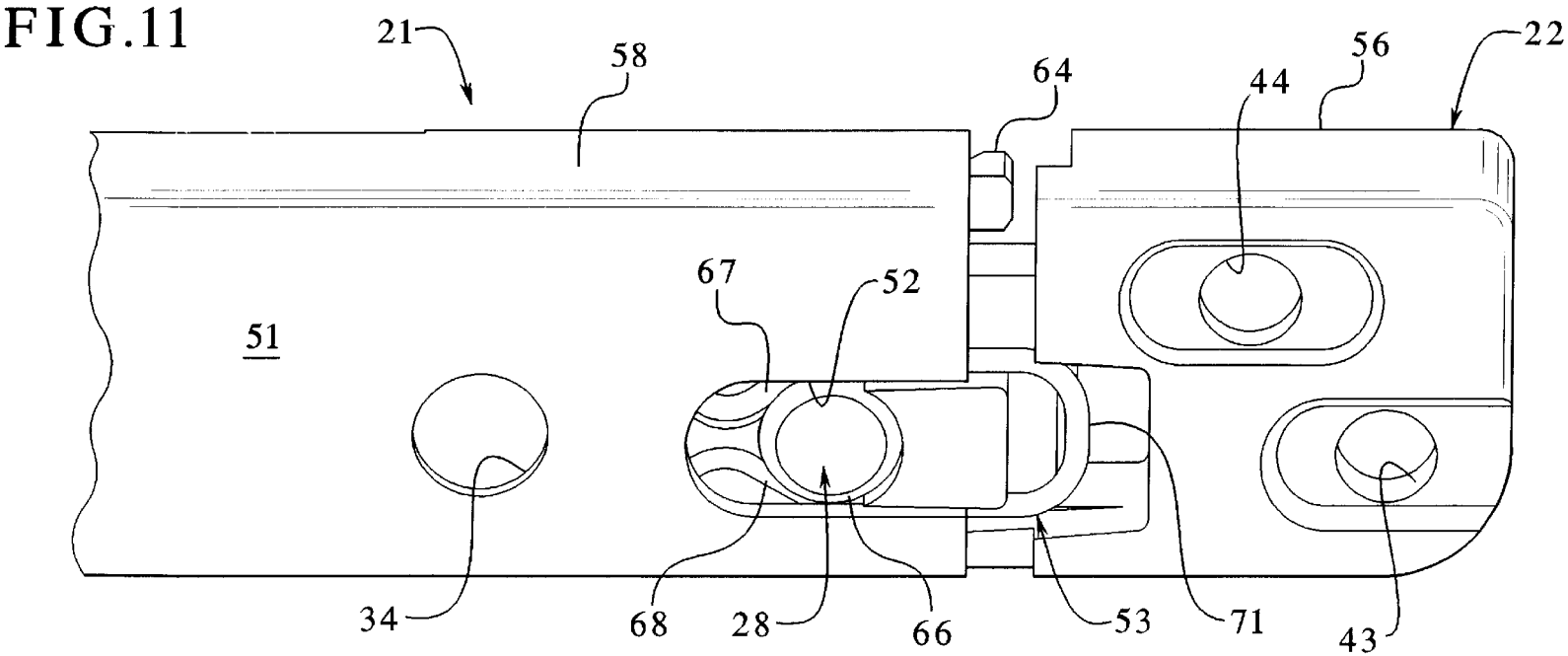
FIG. 11 is another schematic bottom plan view of the track, pivot base, pivot pin and retainer shown in FIG. 9, particularly illustrating the retainer engaging the pivot pin to pivotally secure the pivot pin to the pivot base and further illustrating the access slot for engaging the retainer and the window in the track that exposes the pivot pin.

FIG. 1 is a perspective view of a casement window hinge assembly 20 made in accordance with the present invention. The assembly includes a track 21 which is connected to a pivot base 22 and which is slidably connected to a slide block 23. The pivot base 22 is illustrated in greater detail in FIGS. 4–10 and the side block 23 is illustrated in greater detail in FIGS. 12–13. The slide block 23 is pivotally connected to the tie bar 24 which is secured to the underside of the window sash (not shown). Numerous holes 25 are provided in the tie bar or "sash arm" 24 for purposes of securing the sash arm 24 to the underside of the window sash (not shown). The sash arm 24 is pivotally connected to a second shorter tie bar 26 at the pin 27. The shorter tie bar 26, also known as a "toggle link" 26, is pivotally secured to the pivot base 22 by the pin 28. After installation, the track 21 and pivot base are secured to the window sill (not shown). Accordingly, the position of the pivot pin 28 is fixed during use. As the window is opened, the sash (not shown) and sash arm 24 swing outward in the direction of the arrow 31. As the sash arm 24 and sash swing outward, the slide block 23 and the end 32 of the sash arm 24 move down the track 21 in the direction of the arrow 33. Thus, the pivot access of the window sash moves down the track 21 thereby enabling the user to have access to both sides of the window sash (not shown) for cleaning and repair purposes.

Figure 2:
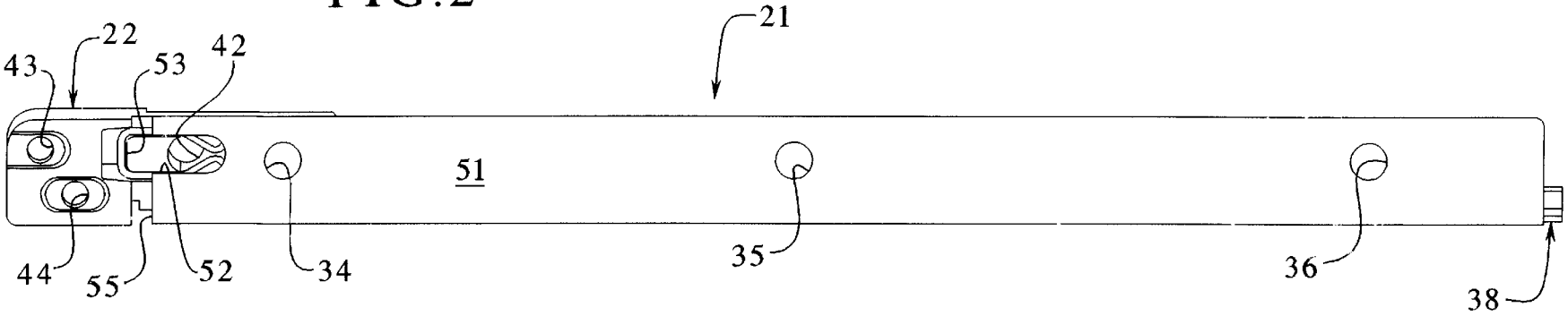
FIG. 2 is a bottom plan view of the hinge assembly shown in FIG. 1.
Figure 3:
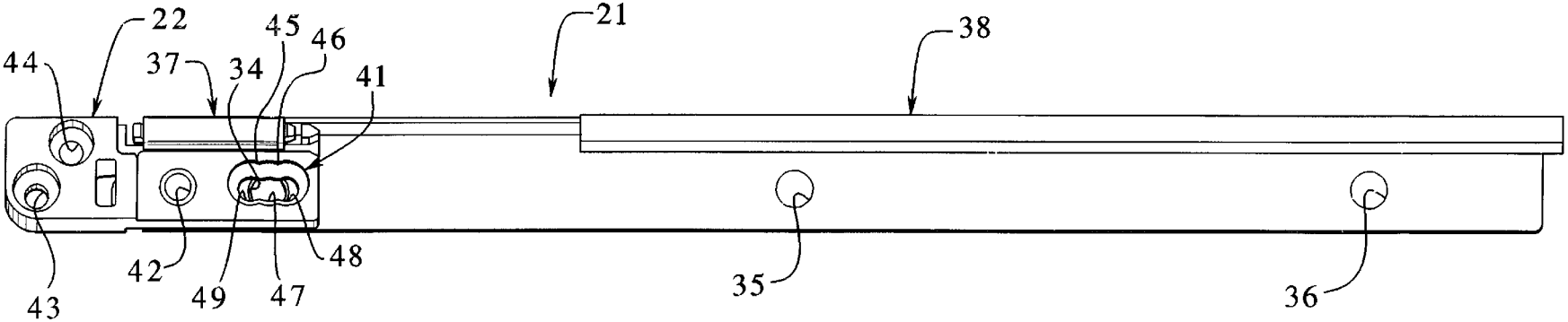
FIG. 3 is a top plan view of the hinge assembly shown in FIG. 1.

Turning to FIGS. 2 and 3, it will be noted that the track 21 includes three holes 34, 35 and 36 for securing the track 21 to the window sill (not shown). The hole 34 is also used to secure the pivot base 22 to the track 21 as well as the window sill. The track 21 also includes two overhangs 37, 38 (see FIG. 3). The overhang 37 is used to slidably hold the pivot base 22 in place while the pivot base 22 is being assembled to the track 21 and the window sill. The overhang 38 is used to slidably retain the slide block 23 (see FIG. 1) along the track 21.

Referring to FIG. 3, the pivot base 22 includes four separate holes including an elongated hole 41 and round holes 42, 43 and 44. As discussed in greater detail below, it will be noted that the elongated hole 41 includes two notches 45, 46 that divide the hole 41 into three slots including a middle or neutral slot 47 disposed between a right slot 48 and a left slot 49. As discussed in greater detail below, this slotted arrangement of the elongated hole 41 enables the position of the pivot base 22 with respect to the track 21 to be adjusted which, in turn, enables the position of the pivot pin 28 (see FIG. 1) with respect to the track 21 to be adjusted because the position of the pivot pin 28 with respect to the pivot base 22 is fixed by way of attachment of the pivot pin 28 to the pivot base 22 at the hole 42. The holes 43 and 44 can be used to secure the pivot base 22 to the window sill. Only one hole, either 43 or 44, needs to be used at a time. Thus, if adjustments are made in the future to correct for sash sag, an extra hole will be available which will ensure that an unused or undrilled portion of the window sill surface is available to receive a threaded fastener. Also, in extremely windy areas, both holes 43, 44 can be used to provide extra strength to the structure.

Returning to FIG. 2, it will be noted that the underside 51 of the track 21 includes a window 52 which provides extra room for the pivot pin 28 (see FIG. 1) to extend downward before engaging the retainer 53. The connection between the pivot pin 28 and the retainer 53 will be discussed in greater detail below with respect to FIGS. 7–11.

Figure 4:
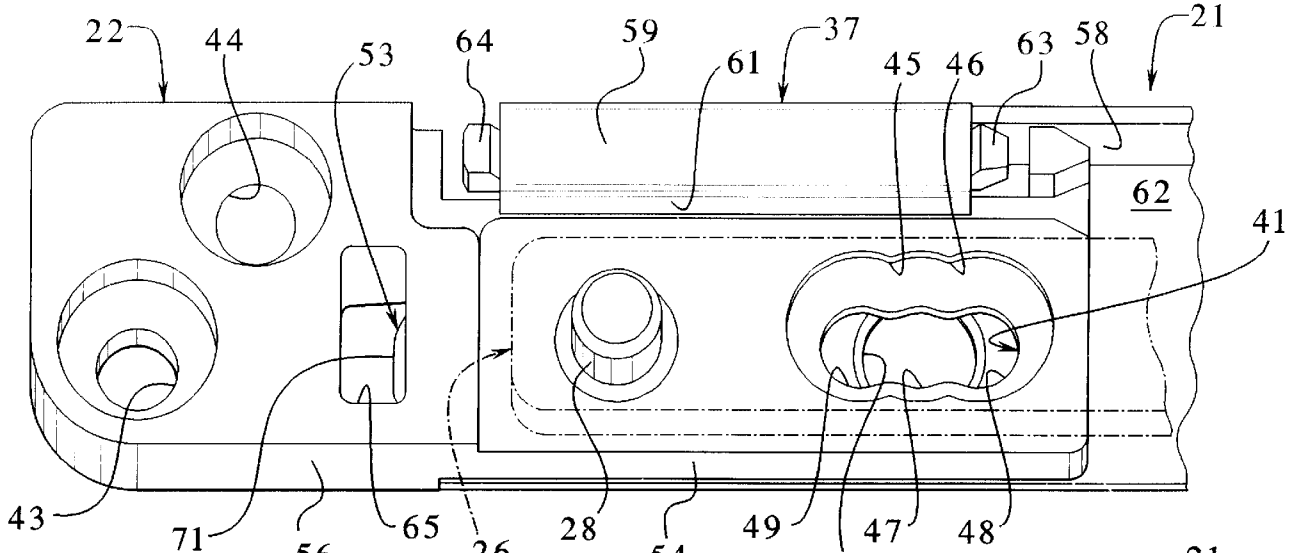
FIG. 4 is an enlarged partial perspective view of one end of a hinge assembly made in accordance with the present invention, particularly illustrating the pivot base, the connection of the pivot base to one end of the track and the connection of the short tie bar to the pivot base, the pivot base being shown in a neutral position with respect to the track.
Figure 5:
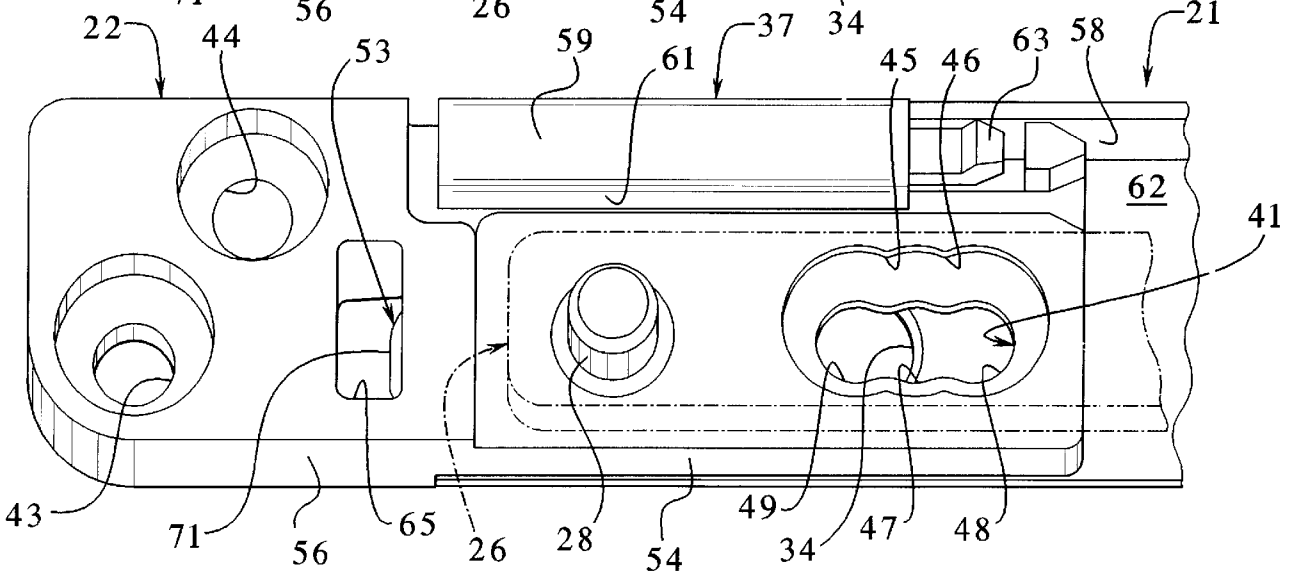
FIG. 5 is another enlarged partial perspective view of the hinge assembly shown in FIG. 4 with the pivot base in the right position with respect to the track.
Figure 6:
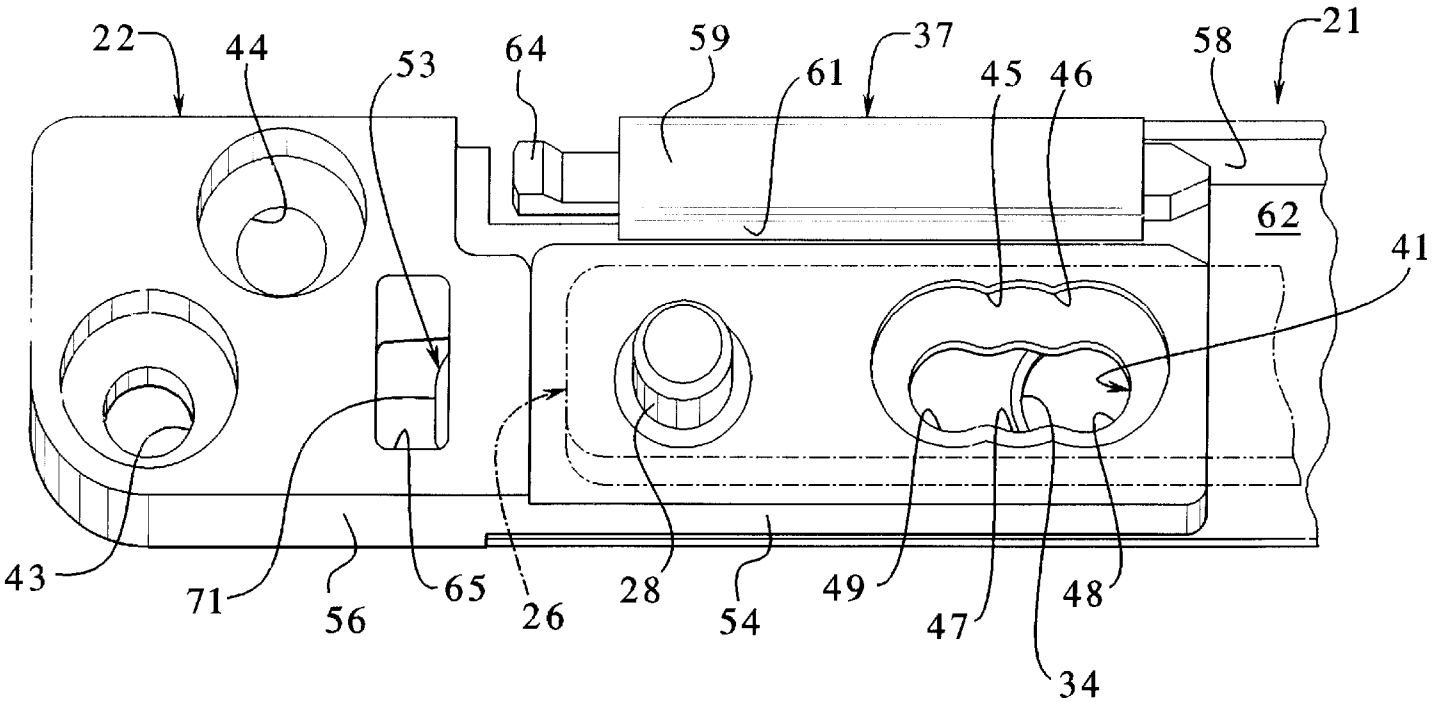
FIG. 6 is another partial enlarged perspective view of the hinge assembly shown in FIG. 4 with the pivot base being in the left position with respect to the track.

FIGS. 4–6 illustrate the relative positioning of the pivot base 22 with respect to the track 21 in greater detail.

Specifically, the pivot base 22 includes a first end section 54 that is slidably received in the end 55 of the track 21 (see also FIG. 2). The pivot base also includes a second end section 56 that extends outward from the end 55 of the track 21. The first end section 54 includes a vertical wall 57 that is trapped beneath the overhang 37 of the track 21 (see FIGS. 9 and 10). Referring back to FIGS. 4–6, the overhang 37 includes a vertical wall 58 that is connected to a horizontal wall 59 which, in turn, is connected to a downwardly extending flange 61. The vertical or retaining wall 57 of the first end 54 of the pivot base 22 is trapped between the flange 61 and the vertical wall 58 of the overhang 37.

As shown in FIG. 4, the elongated slot or hole 41 is positioned over the hole 34 in the bottom wall 62 of the track 21 so that the center or neutral slot 47 is in matching registry with the hole 34. In this position, both the right tab 63 and the left tab 64, which are connected to the retaining wall 57 (see FIGS. 9 and 10) are visible and extend beyond the horizontal wall 59 of the overhang 37.

In contrast, as shown in FIG. 5, the elongated hole 41 has been shifted to the right thereby placing the left slot 49 in matching registry over the hole 34 in the track 21. In this position, the right tab 63 extends outward beyond the horizontal wall 59 of the overhang 37 and is visible to the installer or adjuster. In contrast, the left tab 64 (see FIG. 4) is now hidden beneath the horizontal wall 59. In the position shown in FIG. 5, the right tab 63 provides a clear indication that the pivot base has been shifted to the right thereby placing the left slot 49 in matching registry over the hole 34. In contrast, turning to FIG. 6, it is shown that the elongated hole 41 has been shifted to the left thereby placing the right slot 48 in matching registry over the hole 34. In this position, the right tab 63 is now hidden beneath the horizontal wall 59 of the overhang 37 and the left tab 64 extends outward beyond the horizontal wall and is clearly visible to the adjuster or installer.

Thus, when the pivot base 22 is shifted to the right, the right tab 63 is visible as shown in FIG. 5. When the pivot base 22 is shifted to the left, the left tab 64 is visible as shown in FIG. 6. When the pivot base 22 is shifted to neither the extreme right position (FIG. 5) or the extreme left position (FIG. 6), both tabs 63 and 64 are visible and extend beyond the horizontal wall 59 as shown in FIG. 4. Thus, when two tabs are visible, it is an indication to the adjuster or installer that the pivot base 22 is in the neutral position as shown in FIG. 4. Again, shifting the pivot base 22 with respect to the track 21 as shown above enables a shift in the position of the pivot pin 28 with respect to the track 21 because the pivot pin 28 is pivotally connected to the pivot base 22 through the hole 42 (see FIG. 3).

Also shown in FIGS. 4–6 is the window or access slot 65 in the second end section 56 of the pivot base 22. The slot 65 provides access to the retainer 53. Specifically, a simple tool, such as a flat head screwdriver (not shown) can be inserted through the slot 65 to engage the retainer 53. This action will be discussed further with respect to FIGS. 7–11.

Figure 7:
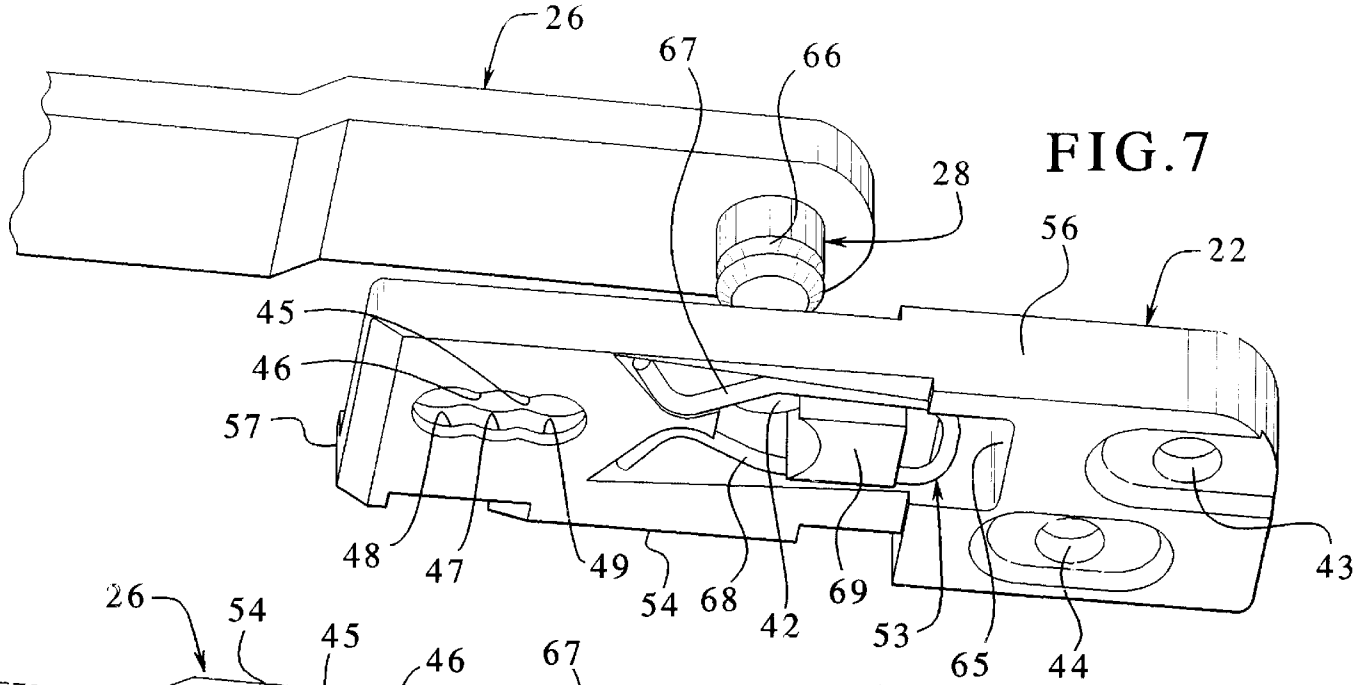
FIG. 7 is a partial exploded view of a short tie bar and pivot base made in accordance with the present invention.
Figure 8:
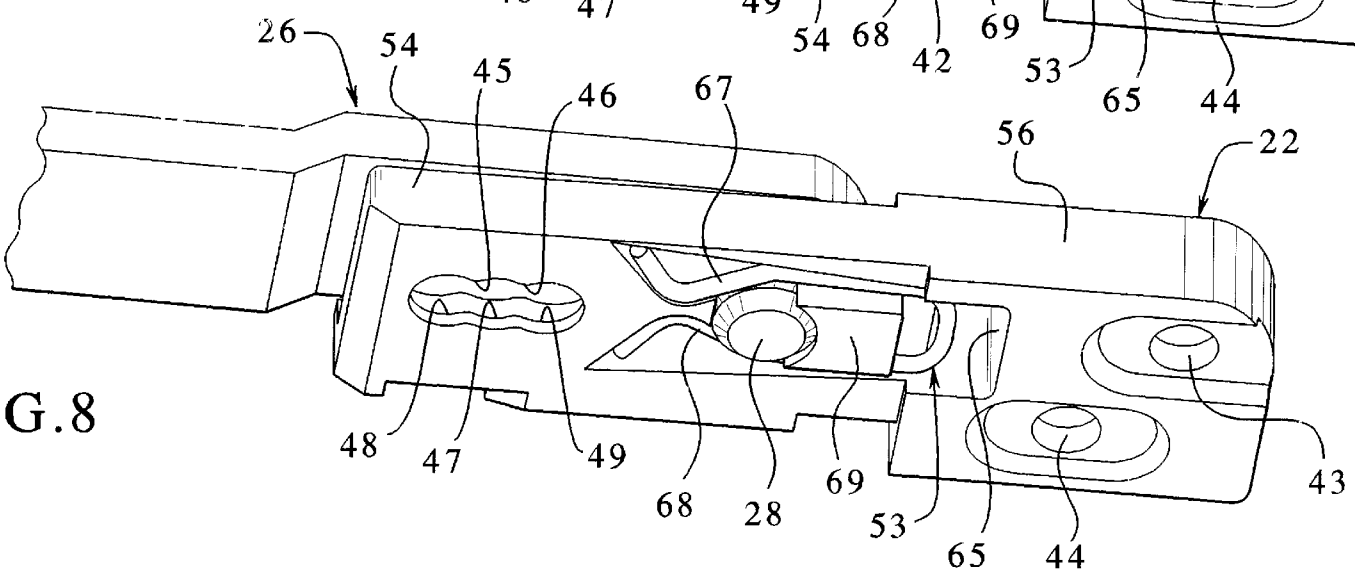
FIG. 8 is a perspective view of the short tie bar and pivot base shown in FIG. 7.

Turning to FIGS. 7–8, the pivot pin 28 is connected to the tie bar or toggle link 26. The pivot pin 28 includes a groove 66 for receiving the retainer 53. As shown in FIG. 7, the pivot pin 28 is inserted downward through the hole 42 in the pivot base 22 so that the tie bar 26 remains on top of the pivot base 22. By connecting the pivot pin 28 to the tie bar 26, any riveting of a pivot pin or cam system to the track 21 is avoided. A more secure attachment of the pivot pin 28 is provided by riveting the pivot pin 28 to the sash arm 26 as opposed to the track 21 because the sash arm 26 will typically be made from material that is about three times as thick as the sheet metal material used to fabricate the track 21. Further, as shown in FIG. 7, the pivot pin 28 is disposed below the tie bar 26 and therefore is hidden from view. Thus, an unsightly clip cannot be seen by the user of the window. Still further, because the pivot pin 28 is fixedly connected to the tie bar 26, there is no frictional contact between the tie bar 26 and a pivot pin which would result in any coating on the tie bar 26 being worn away thereby permitting premature corrosion.

Figure 9:
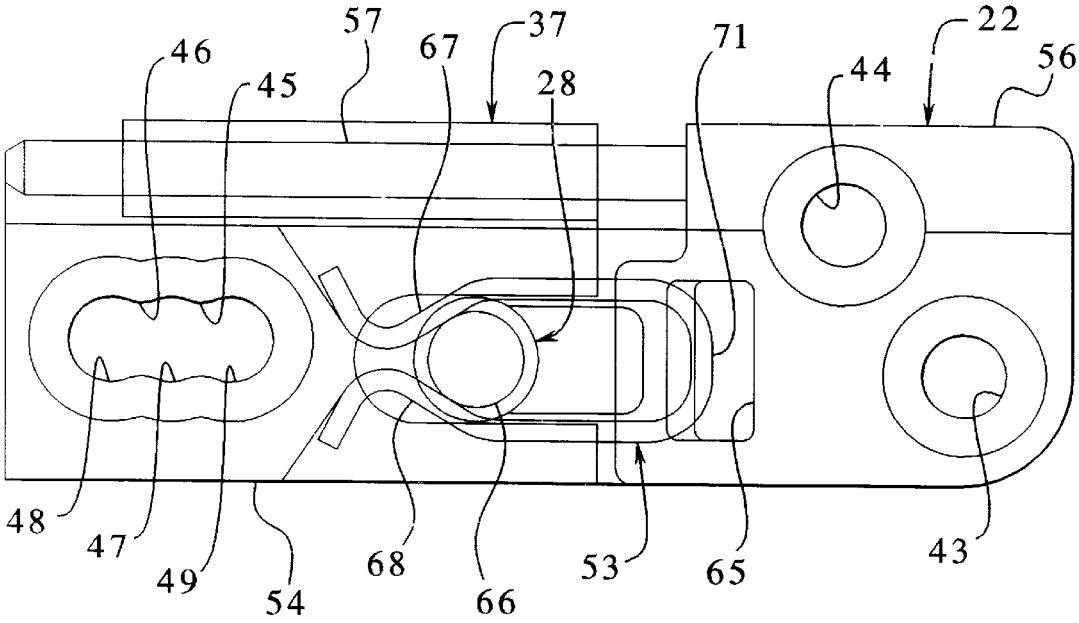
FIG. 9 is a bottom schematic view of a pivot base, track, tie bar pivot pin and retainer made in accordance with the present invention, particularly illustrating the retainer engaging the pivot pin to pivotally secure the pivot pin to the pivot base and further illustrating the access slot for engaging the retainer.
Figure 10:
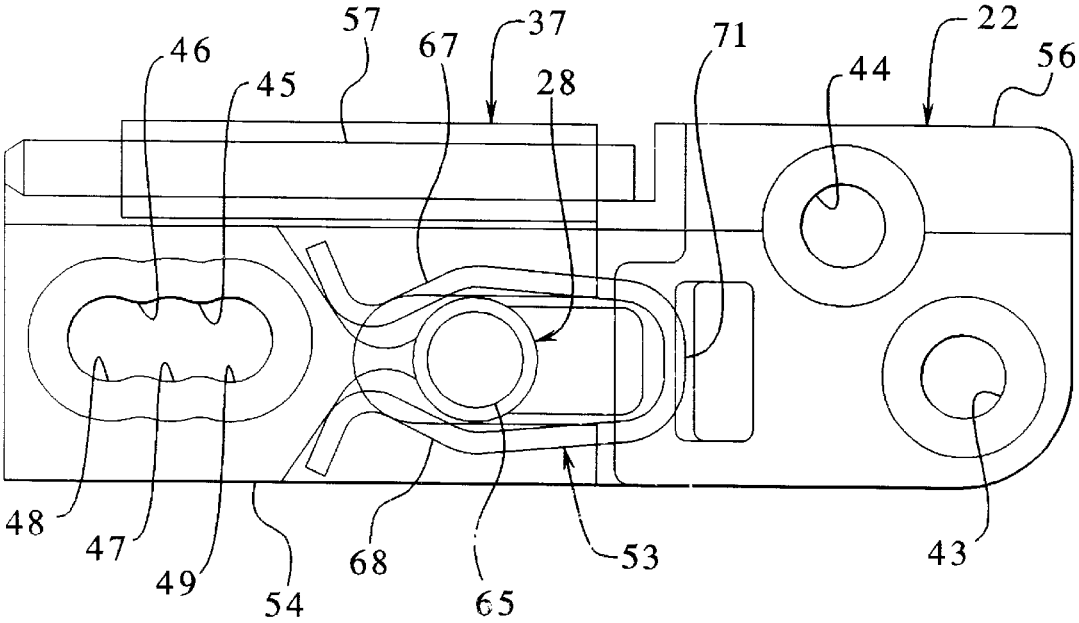
FIG. 10 is another schematic bottom plan view of the track, pivot base, pivot pin and retainer shown in FIG. 9, particularly illustrating movement of the retainer to the left for purposes of disengaging the pivot pin from the pivot base.

Turning to FIG. 8, the pivot pin 28 is inserted through the hole 42 and is received between the legs 67, 68 of the retainer 53 in a snap fit. A reinforcing block 69 is provided for additional support. Turning to FIGS. 9 and 10, it can be seen that the U-shaped end 71 of the retainer 53 can be accessed through the slot 65 when the legs 67, 68 of the retainer 53 are accommodated in the groove 56 of the pivot pin 28 as shown in FIG. 9. In other words, FIG. 9 illustrates the retained position of the pivot pin 28 in the pivot base 22. As shown in FIG. 10, the U-shaped end 71 of the retainer 53 has been pushed to the left thereby disengaging the legs 67, 68 from the groove 65 of the pivot pin 28. The retainer 53 has been released from the pivot pin 28 and the pivot pin 28 and sash arm 26 may be pulled upward to disengage the sash arm 26 from the pivot base 22. The shape of the slot or window 65 enables this feat to be accomplished with a standard tool, such as a flat head screwdriver or other suitable object.

It will be noted that the pivot base 22 acts as a riser block, supporting and lifting the tie bar 26 as the sash is closed. The pivot base 21 ensures that a sagging window sash will always pull up when closed and will be in the correct position for the locking system (not shown) to activate. Preferably, the pivot base 22 is fabricated from an engineered plastic so that there is no metal-to-metal contact at the bearing connection between the tie bar 26 and the pivot base 22. Utilizing a plastic pivot base 22 provides a smooth, near frictionless action without the possibility of damaging coatings on the tie bar 26, which would lead to premature corrosion.

Figure 12:
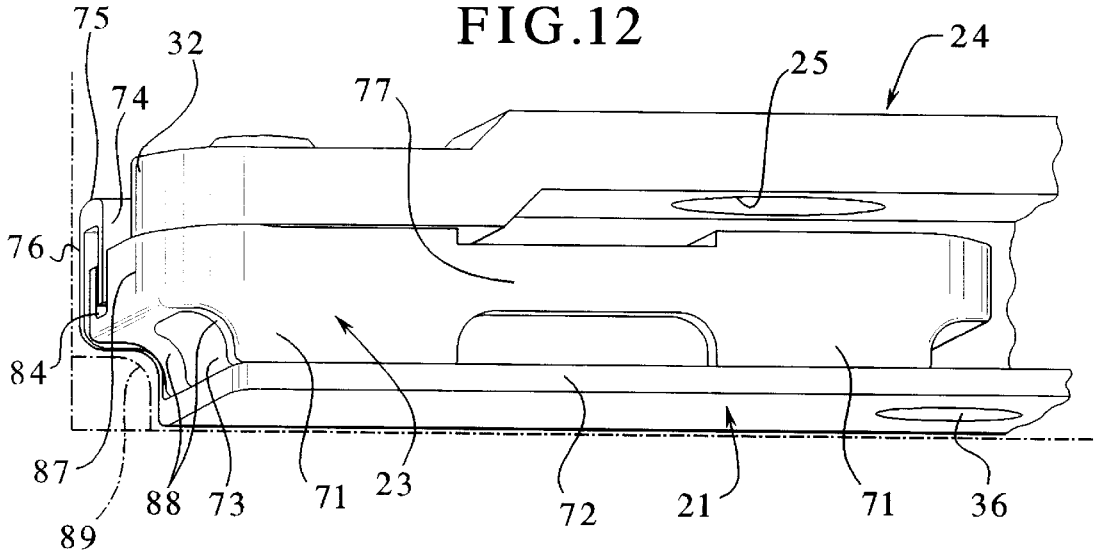
FIG. 12 is a partial perspective view of a long or sash tie bar, slide block and track made in accordance with the present invention.
Figure 13:
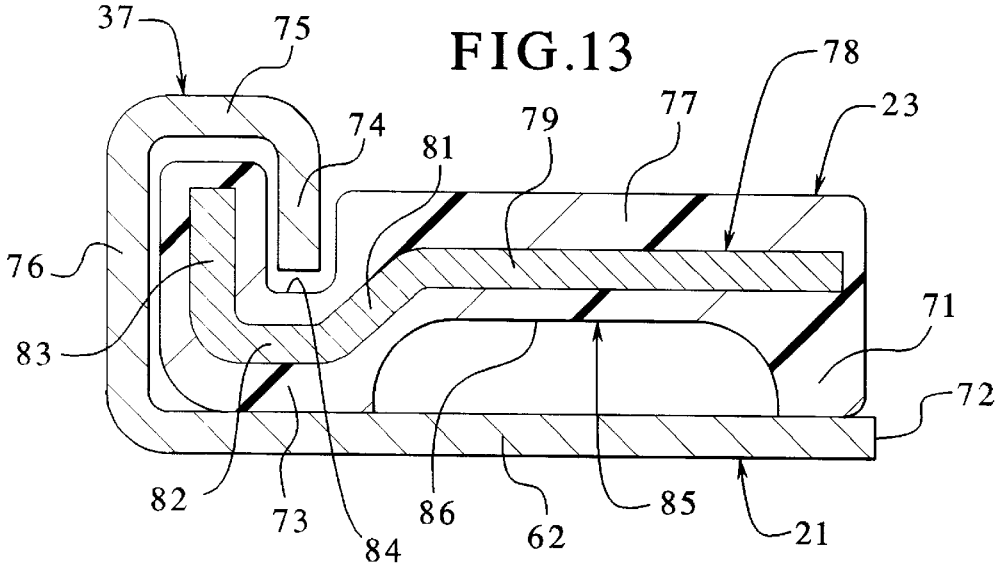
FIG. 13 is a sectional view of a slide bar and track made in accordance with the present invention.
Figure 14:
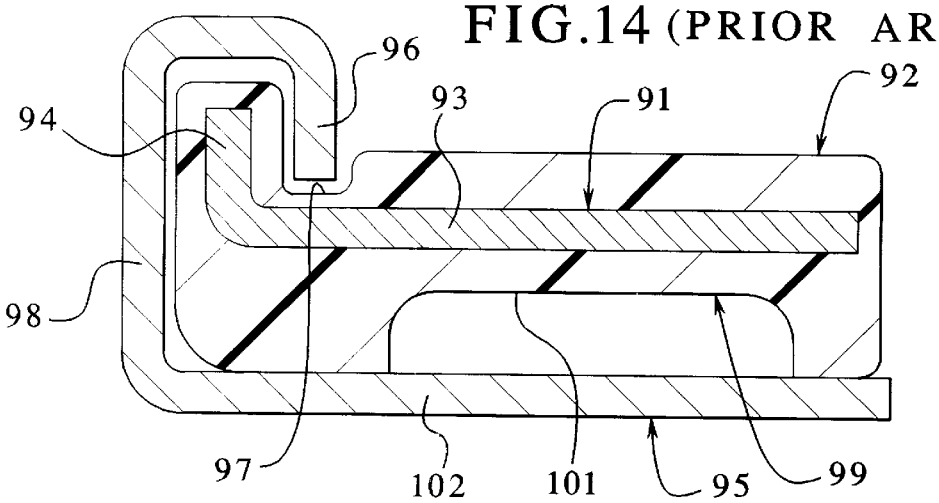
FIG.14 (PRIOR ART)
FIG. 14 is a sectional view of a prior art slide block and track.

Turning to FIGS. 12–14, the slide block 23 is illustrated and compared with a slide block 71 that is known in the art. The slide block 23 includes outer rails 71 disposed adjacent to the free edge 72 of the track 21 as well as an inner rail 73. As shown in FIG. 13, the inner rail 73 extends beneath the downwardly extending flange 74 and the horizontal wall 75 of the overhang 37. The overhang 37 also includes a vertical wall 76 which connects the horizontal wall 75 to the bottom wall 62 of the track 21. The inner rail 73 and outer rails 71 support a base section 77 of the slide block 23. The slide block 23 also includes a reinforcing plate 78 which includes an upper horizontal portion 79 which extends at least partially through the base section 77. The horizontal portion 79 is connected to a ramp portion 81 which extends downward as shown in FIG. 13 to a lower horizontal portion 82 which, in turn, is connected to a vertical portion 83. The ramp portion 81, lower horizontal portion 82 and vertical portion 83 extend downward below and around the slot 84 which accommodates the downwardly extending flange 74 of the overhang 37.

The combination of the downward and then upward path provided by the ramp portion 81, lower horizontal portion 82 and vertical portion 83 of the reinforcing plate provides superior strength and pull-out resistance in comparison to the reinforcing plate 91 of the prior art slide block 92 shown in FIG. 14. Specifically, the reinforcing plate 91 as shown in FIG. 14 includes only a flat horizontal portion 93 which is connected at a right angle to the small vertical portion 94. The embodiment of the invention as shown in FIG. 13 provides a stronger connection to the track 21 than the connection between the prior art slide block 92 and the prior art track 95 because the downwardly extending flange 74 of the embodiment shown in FIG. 13 can be longer than the flange 96 of FIG. 14 due to the deeper recess provided by the slot 84 (FIG. 13) as compared to the shallow slot 97 (FIG. 14). Further, the embodiment shown in FIG. 13 provides a lower overall profile, meaning that the vertical wall 76 as shown in FIG. 13 is shorter than the vertical wall 98 as shown in FIG. 14. Thus, the embodiment illustrated in FIG. 13 provides a stronger connection between the slide block 23 and the track 21 than the slide block 92 and the track 95 as shown in FIG. 14 and, further, the embodiment shown in FIG. 13 provides a lower vertical profile than the prior art slide block 92 and track 95 as shown in FIG. 14.

Still further, the configuration of the reinforcing plate 78 as shown in FIG. 13 enables the undercut portion 85 to extend upward and provide a greater clearance than the undercut portion 99 as shown in FIG. 14. In other words, the flat horizontal wall 86 of the undercut portion 85 is spaced a greater distance above the bottom wall 62 of the track 21 as compared to the distance between the wall 101 of the undercut 99 and the bottom wall 102 of the track 95. Thus, the embodiment illustrated in FIG. 13 provides greater clearance over fasteners used to secure the track 21 to the window sill than the embodiment shown in FIG. 14.

Returning to FIG. 12, it will be noted that the end face 87 of the slide block 23 is connected to the inner rail 73 and outer rail 71 by a recessed portion shown at 88. The recess 88 enables the slide block 23 to avoid engagement with a vinyl seam shown in phantom at 89. Typically, vinyl windows are accompanied by such a seam 89 at the corners of the window which can engage a hinge assembly if the assembly needs to be installed close to the corner of the window. The recessed portion 88 avoids this engagement.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A hinge assembly for a casement window, the hinge assembly comprising:

a track, a tie bar, a pivot base connecting the tie bar to the track, a first fastener for connecting the pivot base and the track to the window, a second fastener for connecting the pivot base to the window, the track comprising an elongated horizontal bottom wall comprising an elongated free side edge, the bottom wall being connected to an overhang opposite the free side edge, the track further comprising an end and a hole disposed in the bottom wall, the pivot base comprising a body comprising two opposing ends including a first end of the body slidably received in the end of track and at least partially underneath the overhang and a second end of the body disposed outside of the track, the first end comprising a first elongated hole in overlapping registry with the hole of the track, the first elongated hole of the pivot base and the hole of the track receiving the first fastener, the first elongated hole comprising a plurality of slots, the slots being shaped to receive the first fastener, the slots being shaped so that only one slot can be in matching registry with the hole in the track at a time, the second end comprising at least a second hole for receiving the second fastener, the pivot base further comprising a third hole, the tie bar being connected to a downwardly extending pivot pin, the pivot pin being received in the third hole of the pivot base, whereby adjusting the position of the first elongated hole of the pivot base with respect to the hole in the track permits the position of the pivot pin with respect to the track to be adjusted.

2. The hinge assembly of claim 1 wherein the first elongated hole comprises three slots including a neutral slot disposed between a right slot and a left slot.

3. The hinge assembly of claim 2 wherein the overhang of the track comprises a vertical wall connected to a horizontal wall so that the vertical wall is disposed between the bottom wall and the horizontal wall, the horizontal wall being connected to a downwardly extending flange so that the horizontal wall is disposed between the flange and the vertical wall, the body of the pivot base comprising a retaining wall that extends upward between the flange and the vertical wall of the overhang, the retaining wall of the pivot base comprising a right prong and left prong, the right and left prongs engaging the horizontal wall of the overhang when the neutral slot of the first elongated hole is in matching registry with the hole in the track, the left prong engaging the horizontal wall of the overhang and the right prong being disposed outside of the overhang when the left slot of the first elongated hole is in matching registry with the hole in the track, the right prong engaging the horizontal wall of the overhang and the left prong being disposed outside of the overhang when the right slot of the first elongated hole is in matching registry with the hole in the track.

4. The hinge assembly of claim 1 wherein the second end of the body of the pivot base comprises a fourth hole that is spaced apart from the second hole.

5. The hinge assembly of claim 1 wherein the body of the pivot base comprises an underside and the pivot pin comprises a distal end, and wherein the pivot base further comprises a retainer secured to the underside of the body of the pivot base, the retainer engaging the distal end of the pivot pin after the pivot pin has passed downward through the third hole, the retainer removably and pivotally securing the pivot pin the third hole.

6. The hinge assembly of claim 5 wherein the retainer is a spring clip.

7. The hinge assembly of claim 5 wherein the body of the pivot base further comprises an access slot disposed above the retainer for permitting a tool to be inserted through the slot to engage and move the retainer to disengage the retainer from the pivot pin.

8. The hinge assembly of claim 7 wherein the tool is a flat head screwdriver.

9. The hinge assembly of claim 1 wherein the track further comprises a secondary hole and a tertiary hole disposed in the bottom the track and remotely spaced from the pivot base.

10. A hinge assembly for a casement window, the hinge assembly comprising:

a track, a tie bar, a pivot base connecting the tie bar to the track, a first fastener for connecting the pivot base and the track to the window, a second fastener for connecting the pivot base to the window, the track comprising an elongated horizontal bottom wall comprising an elongated free side edge, the bottom wall being connected to an overhang opposite the free side edge, the track further comprising an end and a hole disposed in the bottom wall, the pivot base comprising a body comprising two opposing ends including a first end of the body slidably received in the end of track and at least partially underneath the overhang and a second end of the body disposed outside of the track, the first end comprising a first hole in registry with the hole of the track, the first hole of the pivot base and the hole of the track receiving the first fastener, the second end comprising at least a second hole for receiving the second fastener, the pivot base further comprising a third hole, the tie bar being connected to a downwardly extending pivot pin, the pivot pin being received downward through the third hole of the pivot base, the body of the pivot base further comprising an underside and a retainer secured to the underside of the body of the pivot base, the retainer engaging the pivot pin after the pivot pin has passed through the third hole, the retainer removably and pivotally securing the pivot pin to the third hole of the pivot base.

11. The hinge assembly of claim 10 wherein the retainer is a spring clip.

12. The hinge assembly of claim 10 wherein the body of the pivot base further comprises an access slot disposed above the retainer for permitting a tool to be inserted through the slot to engage the retainer and disengage the retainer from the pivot pin.

13. The hinge assembly of claim 12 wherein the tool is a flat head screwdriver.

14. The hinge assembly of claim 10 wherein the first hole of the pivot base is an elongated hole that is in overlapping registry with the hole in the track and whereby adjusting the position of the first elongated hole of the pivot base with respect to the hole in the track permits the position of the pivot pin with respect to the track to be adjusted.

15. The hinge assembly of claim 14 wherein the first elongated hole comprises three distinct slots including a neutral slot disposed between a right slot and a left slot, the slots being shaped to receive the first fastener, the slots being shaped so that only one of the slots can be in matching registry with the hole in the track at a time.

16. The hinge assembly of claim 15 wherein the overhang of the track comprises a vertical wall connected to a horizontal wall so that the vertical wall is disposed between the bottom wall and the horizontal wall, the horizontal wall being connected to a downwardly extending flange so that the horizontal wall is disposed between the flange and the vertical wall, the body of the pivot base comprising a retaining wall that extends upward between the flange and the vertical wall of the overhang, the retaining wall of the pivot base comprising a right prong and left prong, the right and left prongs engaging the horizontal wall of the overhang when the neutral slot of the first elongated hole is in matching registry with the hole in the track, the left prong engaging the horizontal wall of the overhang and the right prong being disposed outside of the overhang when the left slot of the first elongated hole is in matching registry with the hole in the track, the right prong engaging the horizontal wall of the overhang and the left prong being disposed outside of the overhang when the right slot of the first elongated hole is in matching registry with the hole in the track.

17. The hinge assembly of claim 10 wherein the second end of the body of the pivot base comprises a forth hole that is spaced apart from the second hole.

18. The hinge assembly of claim 10 wherein the track further comprises a secondary hole and a tertiary hole disposed in the bottom the track and remotely spaced from the pivot base.

19. A hinge assembly for a casement window, the hinge assembly comprising:

a track, a tie bar, and a pivot base connecting the tie bar to the track, the track comprising an end, the pivot base comprising a body comprising two opposing ends including a first end of the body slidably received in the end of track and a second end of the body disposed outside of the track, the first end comprising a hole, the tie bar being connected to a downwardly extending pivot pin, the pivot pin being received downward through the hole of the pivot base so that the tie bar is disposed above the pivot base with the pivot base being disposed between the track and the tie bar, the body of the pivot base further comprising an underside and a retainer secured to the underside of the body of the pivot base, the retainer engaging the pivot pin after the pivot pin has passed through the hole in the pivot base, the retainer removably and pivotally securing the pivot pin to the hole of the pivot base.

20. The hinge assembly of claim 19 wherein the retainer is a spring clip.

21. The hinge assembly of claim 19 wherein the body of the pivot base further comprises an access slot disposed above the retainer for permitting a tool to be inserted through the slot to engage the retainer and disengage the retainer from the pivot pin.

22. The hinge assembly of claim 21 herein the tool is a flat head screwdriver.

* * * * *